United States Patent [19]

Nakajima et al.

[11] Patent Number: 4,572,135

[45] Date of Patent: Feb. 25, 1986

[54] AIR-TO-FUEL RATIO CONTROL SYSTEM FOR AN ENGINE

[75] Inventors: Masataka Nakajima, Tokyo; Yasushi Mase, Hachioji; Yoshiharu Tamura, Yokohama, all of Japan

[73] Assignee: Nissan Motor Company, Limited, Yokohama, Japan

[21] Appl. No.: 666,039

[22] Filed: Oct. 29, 1984

[30] Foreign Application Priority Data

Oct. 31, 1983 [JP] Japan ..... 58-205082

[51] Int. Cl.[4] ..... F02M 7/20

[52] U.S. Cl. ..... 123/440; 123/478; 123/489

[58] Field of Search ..... 123/421, 440, 478, 489

[56] References Cited

U.S. PATENT DOCUMENTS

| | | | |
|---|---|---|---|
| 4,400,944 | 8/1983 | Iwamoto et al. | 123/489 X |
| 4,452,207 | 6/1984 | Moore, Jr. | 123/440 |
| 4,452,209 | 6/1984 | Ohara et al. | 123/489 |

FOREIGN PATENT DOCUMENTS

| | | | |
|---|---|---|---|
| 42163 | 12/1981 | European Pat. Off. | 123/435 |
| 129841 | 10/1977 | Japan . | |
| 28567 | 2/1983 | Japan | 123/489 |

*Primary Examiner*—Tony M. Argenbright

*Attorney, Agent, or Firm*—Schwartz, Jeffery, Schwaab, Mack, Blumenthal & Evans

[57] ABSTRACT

In a carburetor in which air-to-fuel ratio is feedback controlled into a stoichiometric mixture ratio in response to oxygen sensor signals, air-to-fuel ratio is determined to a lower value to supply a rich mixture to an engine when intake air temperature and engine coolant temperature both exceed each reference value, so that engine overheat can be prevented at high temperatures. The lower air-to-fuel ratio is determined to a fixed value or to an appropriate value under consideration of intake air temperature and engine coolant temperature or additionally vehicle speed.

12 Claims, 6 Drawing Figures

AIR-TO-FUEL RATIO CONTROL SYSTEM FOR AN ENGINE

BACKGROUND OF THE INVENTION

1. Field of the Invention

The present invention relates generally to an air-to-fuel ratio control system for an engine and more specifically to an air-to-fuel ratio control system incorporated with an electronically controlled carburetor for prevention of engine overheat.

2. Description of the Prior Art

Air-to-fuel ratio control systems used with an electronically-controlled carburetor are well known. An example of these systems is disclosed in Japan Published Unexamined Patent Application No. 52-129841, entitled Air-to-Fuel Ratio Control System on Engine Closed Loop. In this application, air-to-fuel ratio is controlled to a stoichiometric mixture ratio by actuating an electromagnetic valve provided for a carburetor connected to an engine intake passage, in order to increase or decrease the amount of fuel supplied to the engine. The electromagnetic valve is feedback controlled in response to signals outputted from an oxygen sensor for detecting oxygen concentration in engine exhaust gas. Further, intake air vacuum is detected for correcting air-to-fuel ratio to a rich mixture when engine load is heavy, thus improving engine operating characteristics under heavy engine load.

In the prior-art air-to-fuel ratio control system as described above, however, although engine operating characteristics are improved under a heavy engine load, no consideration is taken for engine operating characteristics of when intake air temperature or the engine coolant temperature is high.

Therefore, even at high temperatures, air-to-fuel ratio is controlled to a stoichiometric mixture value, so that combustion temperature is high in engine combustion chamber. This results in a problem in that exhaust gas temperature rises and additionally the engine is easily overheated.

A more detailed description of the prior-art air-to-fuel ratio control system will be described in more detail under DETAILED DESCRIPTION OF THE PREFERRED EMBODIMENTS.

SUMMARY OF THE INVENTION

With these problems in mind, therefore, it is the primary object of the present invention to provide an air-to-fuel ratio control system incorporated with a carburetor which can prevent engine overheat when intake air temperature and engine coolant temperature are both high.

To achieve the above-mentioned object, the air-to-fuel ratio control system for an engine according to the present invention comprises (a) an oxygen sensor for detecting oxygen concentration in engine exhaust gas and for outputting an oxygen sensor signal; (b) an engine coolant temperature sensor for outputting an engine coolant temperature signal; (c) an intake air temperature sensor for outputting an intake air temperature signal; (d) air-to-fuel ratio control means (103) for correcting the amount of fuel to be supplied to the engine so as to obtain mixture with a stoichiometric mixture ratio in response to the detected oxygen sensor signal in acordance with feedback method when the detected engine coolant temperature of the detected intake air temperature is below each reference value, for increasing the amount of fuel to be supplied to the engine so as to obtain rich mixture irrespective of the oxygen sensor signal for prevention of engine overheat when the detected engine coolant temperature and the detected intake air temperature exceed each reference value, and for outputting a control signal representative of the amount of fuel; and (e) an actuator associated with the carburetor and activated in response to the control signal outputted from said control means.

To achieve the above-mentioned object, the method of increasing fuel supplied to an engine for prevention of engine overheat according to the present inention comprises the following steps of (a) detecting intake air temperature $T_A$; (b) comparing the detected intake air temperature $T_A$ with a reference value $T_{AO}$; (c) if the detected intake air temperature $T_A$ is lower than the reference value $T_{AO}$, supplying fuel into the engine in response to the oxygen sensor signals and in accordance with feedback control method; (d) if the detected intake air temperature $T_A$ is higher than the reference value $T_{AO}$, detecting engine coolant temperature $T_C$; (e) comparing the detected engine coolant temperature $T_C$ with a reference value $T_{CO}$; (f) if the detected engine coolant temperature $T_C$ is lower than the reference value $T_{CO}$, supplying fuel into the engine in response to oxygen sensor signals and in accordance with feedback control method; (g) if the detected engine coolant temperature $T_C$ is higher than the reference value $T_{CO}$, selecting a duty factor from a look-up table under consideration of the detected intake air temperature $T_A$ and the detected engine coolant temperature $T_C$; (h) generating a control pulse signal having the selected duty factor; and (i) activating an actuator associated with the carburetor in response to the control pulse signal to increase the amount of fuel to be supplied to the engine through the carburetor.

BRIEF DESCRIPTION OF THE DRAWINGS

The features and advantages of the air-to-fuel ratio control system for an engine according to the present invention over the prior-art air-to-ratio control system will be more clearly appreciated from the following description of the preferred embodiments of the invention taken in conjunction with the accompanying drawings in which like reference numerals designate the same or similar elements or sections throughout the figures thereof and in which.

DETAILED DESCRIPTION OF THE PREFERRED EMBODIMENTS

To facilitate understanding of the present invention, a brief reference is made to an example of prior-art air-to-fuel ratio control systems for an engine disclosed in Japan Published Unexamined Patent Application No. 52-129841, entitled Air-to-Fuel Ratio Control System on Engine Closed Loop, with reference to the attached drawings.

Figure 1A:
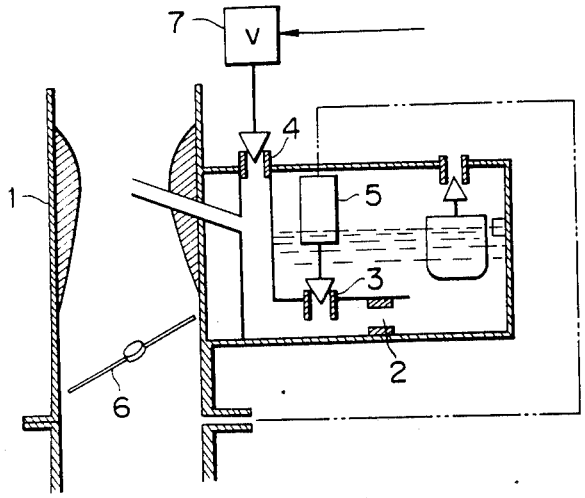
FIG.1(A) (PRIOR ART)
FIG. 1(A) is a diagrammatical illustration showing a carburetor used with the prior-art air-to-fuel ratio control system for an engine.
Figure 1B:
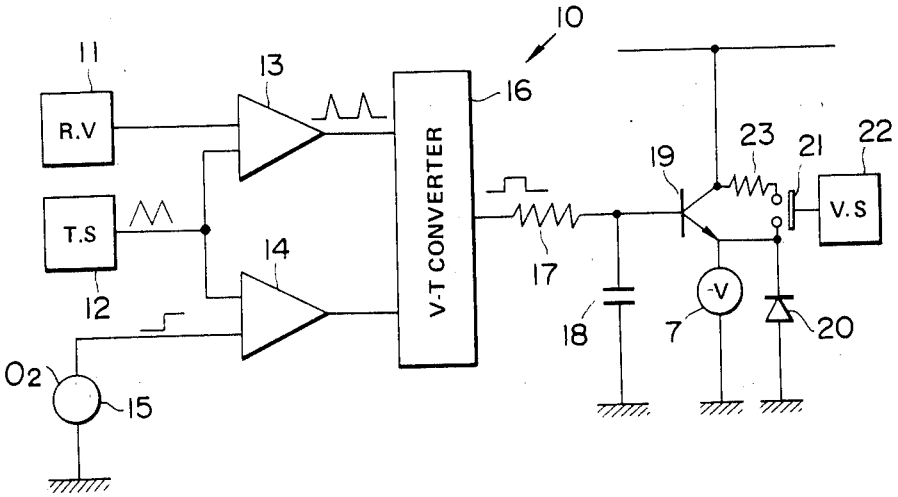
FIG.1(B) (PRIOR ART)
FIG. 1(B) is a schematic block diagram showing a control circuit of the prior-art air-to-fuel ratio control system for an engine.

In FIG. 1A, a carburetor 1 includes a metering jet 2, a power jet 3 and an air bleeder 4. The power jet 3 is adjustably opened by a power mechanism 5 actuated by a vacuum developed on the downstream side of a throttle valve 6. The air bleeder 4 is also adjustably opened by an electromagnetic valve 7 to control mixture to an appropriate air-to-fuel ratio. The electromagnetic valve 7 is controlled by a control unit 10 as shown in FIG. 1(B).

The control unit 10 is made up of a reference voltage generator 11, a triangular wave signal generator 12, two comparators 13 and 14, an oxygen sensor 15, a difference-to-time converter 16, an integrating circuit with a resistor 17 and a capacitor 18, a power transistor 19, a diode 20, a normally-open contact 21 and a vacuum switch 22.

The oxygen sensor 15 generates an electromotive force according to the ratio of oxygen concentration in atmosphere to that in exhaust gas. In other words, a positive voltage is generated when air-to-fuel ratio is below a stoichiometric mixture ratio (rich mixture or insufficient oxygen) and no voltage is generated when air-to-fuel ratio is beyond the stoichiometric mixture ratio (lean mixture or excessive oxygen). The difference-to-time converter 16 converters a difference in voltage between a reference triangular wave signal and oxygen sensor signal into a time interval signal corresponding thereto. That is to say, when the oxygen sensor 15 outputs a high voltage level signal (rich mixture), the converter 16 outputs a signal to activate the electromagnetic valve 7 for a converted time period in order to open the air bleeder 4 or to control the mixture into a lean mixture; when th oxygen sensor 15 outputs a low voltage level signal (lean mixture), the converter 16 outputs no signal to deactivate the electromagnetic valve 7 in order to close the air bleeder 4.

The vacuum switch 22 can close the contact 21 when intake vacuum drops below a predetermined value (e.g. −200 mHg) under a heavy engine load. When the contact 21 is closed, since the emitter and the collector of the power transistor 19 is shorted, the electromagnetic valve 7 is held at a constant voltage level determined by a resistor 23, irrespective of the signal level outputted from the integrating circuit 17 and 18 or the oxygen sensor 15.

In the above-mentioned air-to-fuel ratio control system, air-to-fuel ratio is feedback controlled to a stoichiometric mixture ratio by detecting oxygen concentration within the exhaust gas. Further, when engine load is heavy, and therefore intake vacuum is reduced, the control unit 10 holds the electromagnetic valve 7, irrespective of the signal from the oxygen sensor 15 so that the electromagnetic valve 7 is kept closed to keep carburetor air-to-fuel ratio a little richer than the stoichiometric mixture ratio. Thereafter, when the throttle valve is opened and therefore intake vacuum is increased, the power jet 3 is opened by the vacuum to further obtain a rich mixture. In summary, in this system, the air-to-fuel ratio is feedback controlled by the oxygen sensor 15 for maximizing the efficiency of exhaust gas purification, but the feedback loop is held at a constant level under heavy engine load for maximizing the efficiency of engine power.

In the prior-art air-to-fuel ratio control system as described above, although engine operating characteristics are improved under a heavy engine load, since no special countermeasures are considered against high intake air temperature or high engine coolant temperature, the engine will easily be overheated at high air temperatures or high coolant temperatures.

Figure 2:
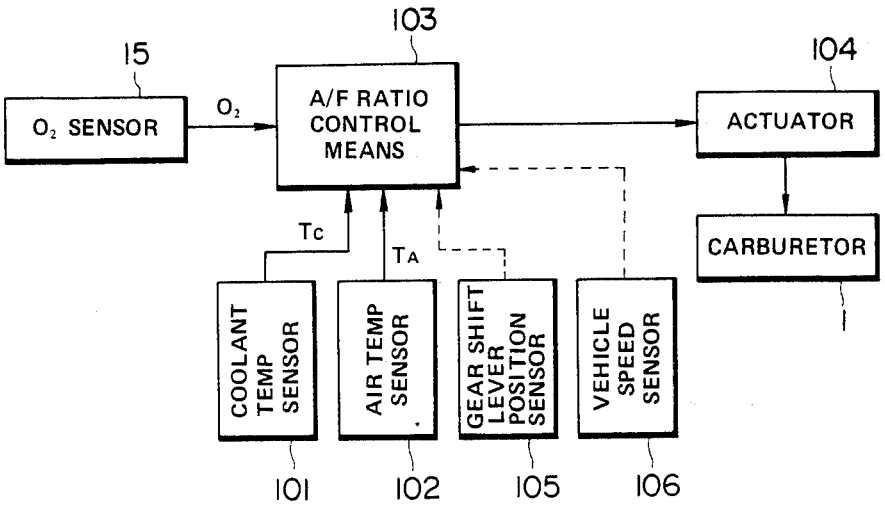
FIG. 2 is a schematic block diagram showing a basic embodiment of the air-to-fuel ratio control system fo an engine according to the present invention.

In view of the above description, reference is now made to a basic embodiment of the air-to-fuel ratio control system for an engine according to the present invention with reference to FIG. 2. The system comprises an oxygen sensor 15, an engine coolant temperataure sensor 101, an intake air temperataure sensor 102, an air-to-fuel ratio control means 103, an actuator 104 and a carburetor 1.

The oxygen sensor 15 outputs a high-voltage level signal when mixture is rich (air-to-fuel ratio is lower than a stoichiometric mixture ratio) but a low-voltage level signal when mixture is lean (air-to-fuel ratio is higher than the stoichiometric mixture ratio), being disposed within an exhaust pipe of an engine.

The engine coolant temperature sensor 101 detects the temperature $T_C$ of engine coolant; the intake air temperature sensor 102 detects the temperature $T_A$ of intake air introduced into the engine.

The air-to-fuel ratio control means 103 determines the amount of fuel to be supplied to the engine in response to signals outputted from the oxygen sensor 15 so that air-to-fuel ratio reaches a target value or a stoichiometric mixture ratio in accordance with feedback method, when the detected engine coolant temperature or the detected intake air temperature is below each reference value; and further determines the amount of fuel to be supplied to the engine, irrespective of the oxygen sensor signal, so that air-to-fuel ratio reaches a richer value in accordance with table look-up method of prevention of engine overheat, when the detected engine coolant temperature and the detected air temperature exceed each reference value. The control means 103 outputs a control signal representative of the determined amount of fuel to be supplied.

The actuator 104 is activated in response to the control signal from the air-to-fuel ratio control means 103. the carburetor 1 supplies an appropriate amount of fuel to the engine according to the amount of intake air and increases or decreases the amount of fuel to be supplied in response to the control signal outputted from the control means 103. In the air-to-fuel ratio control system as described above, in particular, a rich mixture is supplied from the carburetor to the engine when engine coolant temperature $T_C$ and intake air temperature $T_A$ exceed the respective reference values, simultaneously, in order to reduce combustion temperature or to prevent engine overheat at high temperatures. In FIG. 2, the reference numeral 105 denotes a transmission gear shift lever position sensor which can outputs a signal when a gear shift lever is set to Park or Neutral other than Drive positions. The reference numeral 106 denotes a vehicle speed sensor which can output a signal when vehicle speed is zero. Since engine is readily overheated when vehicle is at rest, it is preferable to take vehicle speed into consideration when supplying a rich mixture for prevention of overheat.

Figure 3:
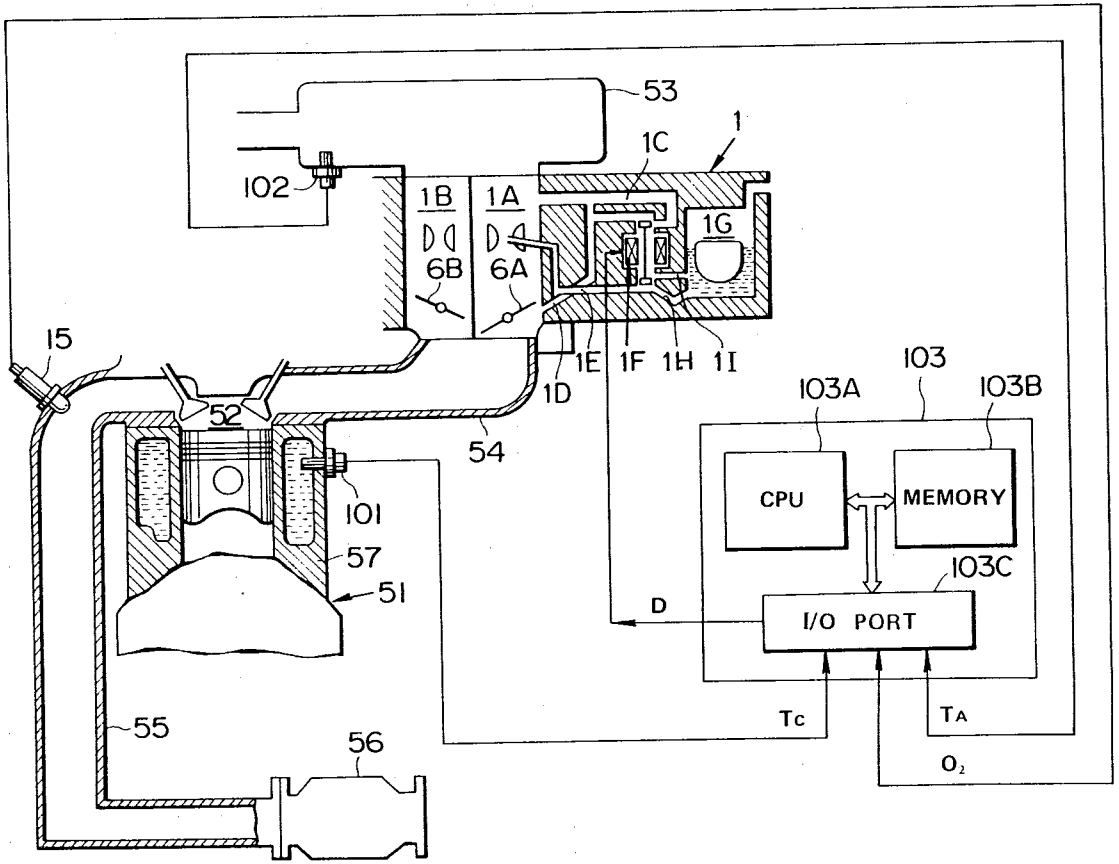
FIG. 3 is a diagrammatical illustration including a schematic block diagram showing an embodiment of the air-to-fuel ratio control system for an engine according to the present invention.

FIG. 3 shows an embodiment of the air-to-fuel ratio control system according to the present invention. An engine 51 is provided with a combustion chamber 52, into which mixture is supplied through an intake pipe 54. The mixture is obtained by mixing intake air cleaned through an air cleaner 53 with fuel supplied through a carburetor 1. Exhaust gas obtained after the mixture has been burnt out within the combustion chamber 52 is introduced through an exhaust pipe 55 to a ternary catalyst converter 56 and then exhausted out. The catalyst converter 56 purifies the exhaust gas by oxidizing chemical components of HC and CO and by deoxidizing chemical component NOx all included in exhaust gas.

The intake air temperature sensor 102 for detecting intake air temperature $T_A$ is disposed at an appropriate position within the air cleaner 53. However, it is also possible to dispose this intake air temperature sensor 102 within the intake pipe 54 for detection of mixture temperature on the downstream side of throttle valves 6A and 6B. Further, it is also possible to dispose this intake air temperature sensor 102 on the outside of the air cleaner 53 for detection of outside air temperature.

The engine coolant temperature sensor 101 for detecting engine coolant temperature $T_C$ is disposed at an appropriate position of an engine cylinder block 57 or a radiator (not shown).

The oxygen sensor 15 for detecting oxygen concentration $O_2$ in exhaust gas is disposed at an appropriate position of an exhaust pipe 55. The oxygen sensor 15 outputs a high-voltage level signal when air-to-fuel ratio is below a stoichiometric mixture ratio or a rich mixture is supplied and therefor oxygen is insufficient but a low-voltage level signal when air-to-fuel ratio is beyond the stoichiometric mixture ratio or a lean mixture is supplied and therefore oxygen is excessive.

The electronically-controlled carburetor 1 is formed with a primary passage 1A within which a primary throttle valve 6A is disposed and a secondary passage 1B within which a secondary throttle valve 6B is disposed. Further, the carburetor 1 is formed with a first passage 1C communicating with the upsteam side of a primary venturi portion, a second passage 1D communicating with the downstream side of a primary throttle valve 6A, and a third passage 1E communicating with the primary venturi portion. In FIG. 3, the reference numeral 1F denotes a solenoid valve and the reference numeral 1G denotes a float chamber. A main jet 1H is formed between the solenoid valve 1F and the float chamber 1G on the low side and an auxiliary jet 1I is formed between the solenoid valve 1F and the float chamber 1G on the upper side both for supplying fuel within the float chamber 1G to the primary venturi portion.

In the above-mentioned carburetor 1, when the solenoid valve 1F is energized, two upper and lower valve members are moved in the upward direction, so that the upper valve member opens to communicate the first and second passages 1C and 1D with the third passage 1E and the lower valve member opens the main jet 1H but closes the auxiliary jet 1I. Therefore, a vacuum applied to the main jet 1H is reduced and further fuel is supplied from only the main jet 1H to the venturi portion. Under these conditions, the amount of fuel to be supplied is relatively small.

In contrast with this, when the solenoid valve 1F is deenergized, two upper and lower valve members are moved in the downward direction, so that the upper valve member closes not to communicate the first and second passages 1C and 1D with the third passage 1E and the lower valve member opens both the main jet 1H and the auxiliary jet 1I. Therefore, vacuum applied to the main jet 1H is increased and further fuel is supplied from both the main jet 1H and the auxiliary jet 1I to the venturi portion. Under these conditions, the amount of fuel to be supplied is relatively great.

The solenoid valve 1F is controlled in response to a control pulse signal D, the duty factor of which is determined by the air-to-fuel ratio control means 103. Duty factor is a ratio (tw/T) of pulse width (Tw) to pulse period (T). Therefore, the more the duty factor D, the more the solenoid valve 1F will be energized to reduce the amount of fuel to be supplied; the less the duty factor, the less the solenoid valve 1F wil be energized to increase the amount of fuel to be supplied. However, it is of course possible to reverse the relationship between the duty factor and the amount of fuel by changing the direction that the solenoid valve 1F is driven when energized.

Further, although not shown, another secondary main jet is provided so as to supply fuel to the venturi portion of the secondary passage 15. In summary, the carburetor 1 supplies fuel to the engine 51 corresponding to the amount of intake air through the primary and secondary main jets and further increases or decreases fuel to be supplied to the engine through the auxiliary jet 1I in response to the control pulse signal D with variable duty factor outputted from the air-to-fuel ratio control means 103.

The air-to-fuel control means 103 is a microcomputer made up of a central processing unit (CPU) 103A, memory units 103B including read-only memory (ROM) and random access memory (RAM) and an input/output port including analog-to-digital converters and digital-to-analog converters. The detection signals outputted from the three sensors 15, 101 and 102 (oxygen concentration $O_2$, air temperature $T_A$ and coolant temperature $T_C$) are all inputted to the control means 103 through the I/O port 103C, through which analog signals are converted digital signals corresponding thereto where necessary. The CPU 105A reads externally-detected data signals, transfers or receives the read data signals to and from the RAM for executing data processing in accordance with control program stored in the ROM and outputs a control signal through the I/O port 103C. Further, in the memory unit 103B, necessary data are previously stored in the form of tables as described later in more detail.

The operation of the air-to-fuel ratio control system according to the present invention will be described hereinbelow.

In the carburetor 1, fuel is supplied from the float chamber 1G to the primary and secondary venturi portions arranged within the primary and secondary passages 1A and 1B through the primary and secondary main jets. Since the vacuum is increased in proportion to an increase in the amount of intake air, the fuel supplied through the two venturi portions is roughly proportional to the amount of intake air. In addition to the above mentioned fuel supply through the primary and secondary main jets, fuel supplied to the primary venturi portion 1A is increased or decreased through the auxiliary jet 1I in response to the control pulse signal D outputted from the control means 103 to the solenoid valve 1F. In more detail, the control means 103 first determines the amount of fuel to be adjusted through the auxiliary jet 1I on the basis of engine coolant temperature $T_C$ detected by the coolant sensor 101 and then corrects the amount of fuel on the basis of the output signal from the oxygen sensor 15. That is to say, when coolant temperature $T_C$ is lower, the control means 103 decreases the duty factor of the control signal D to increase fuel to be supplied through the auxiliary jet 1I; when coolant temperature $T_C$ is sufficiently high, the control means 103 increases the duty factor of the control signal D to decrease fuel to be supplied through the auxiliary jet 1I. Additionally, when the oxygen sensor 15 outputs a high-voltage level signal indicative of rich mixture, the control means 103 increases the duty factor of the control signal D to decrease fuel to be supplied through the auxiliary jet 1I; when the oxygen sensor 15 outputs a low-voltage level signal indicative of lean mixture, the control means 103 decreases the duty factor of the control signal D to increase fuel to be supplied through the auxiliary jet 1I. In summary, air-to-fuel ratio is feedback controlled in response to the oxygen concentration signal outputted from the oxygen sensor 15. Further, in this feedback control method, the amount of fuel to be corrected is adjusted in accordance with proportional-plus-integral control action (PI control), in which fuel is corrected in proportion to an addition of the error signal (H-level signal) and its integral.

In addition to the above-mentioned feedback control, the control means 103 fixedly determines the air-to-fuel ratio at predetermined values (rich mixture), when intake air temperature $T_A$ and engine coolant temperature $T_C$ both exceed respective reference values, irrespective of the detection signal from the oxygen sensor 15. To fix the air-to-fuel ratio, the control means 103 determines a duty factor (e.g. 10 percent) of the control pulse signal D applied to the solenoid valve 1F in accordance with table look-up method. In this table, various duty factors are listed with intake air temperature $T_A$ and coolant temperature $T_C$ as parameters.

These fixed duty factor Do may be determined under consideration of transmission gear shift lever position or vehicle speed in addition to the intake air $T_A$ or coolant temperature $T_C$. This is because when the transmission is shifted to Part or Neutral or when vehicle speed is zero, engine may easily be overheated. Furthermore, it is also possible to determine only a single duty factor without changing it according to various parameters. Further, it should be noted that when temperatures $T_A$ and $T_C$ exceed both each predetermined value, the duty factor is so determined as to obtain a rich mixture (low air-to-fuel ratio). This is because when mixture is rich, since oxygen becomes insufficient, fuel is burnt imperfectly and therefore combustion temperature is reduced, thus it being possible to prevent engine overheat.

Figure 4:
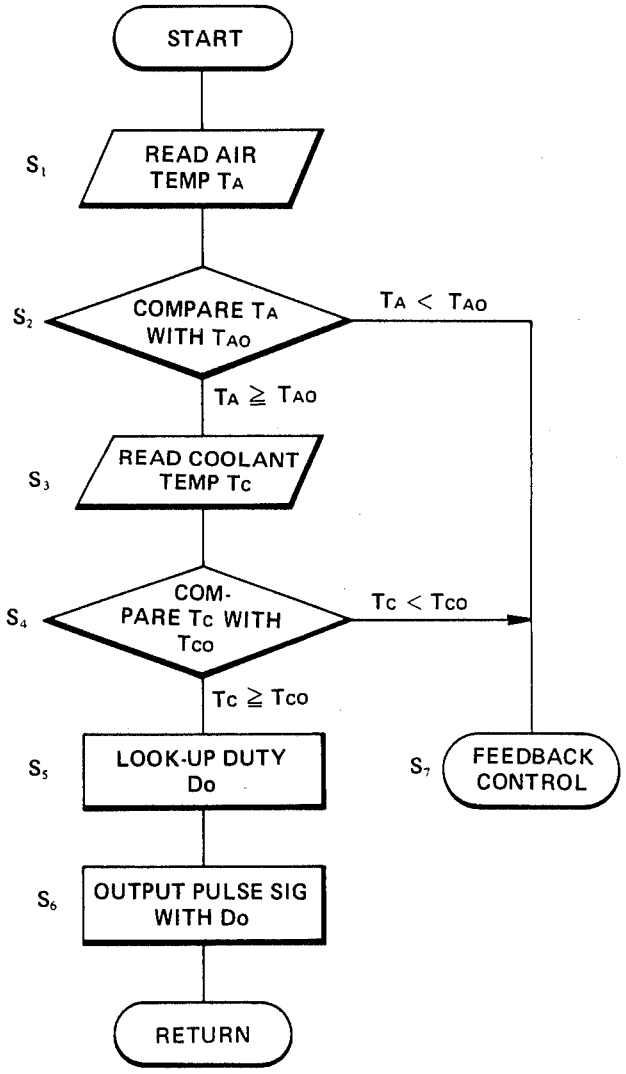
FIG. 4 is a flowchart showing the steps of the method of increasing fuel supplied to an engine for prevention of engine overheat according to the present invention.

The above-mentioned method of determining a rich mixture at high temperatures $T_A$ and $T_C$ will be described in detail with reference to a control flowchart shown in FIG. 4, in which $S_1$ to $S_7$ denote each control step.

The control means 103 first reads an intake air temperature $T_A$ from the intake air temperature sensor 102. in step $S_1$. In step $S_2$, control compares the read intake air temperature $T_A$ with a reference temperature $T_{AO}$ (e.g. 65° C.). If $T_A$ is lower than $T_{AO}$, program control advance to step $S_7$ to feedback control the air-to-fuel ratio in response to the detected oxygen sensor signal. In step $S_2$, if $T_A$ is higher than $T_{AO}$, program control further reads an engine coolant temperature $T_C$ from the coolant temperature sensor 101 in step $S_3$. In step $S_4$, control compares the read coolant temperature $T_C$ with a reference temperature $T_{CO}$ (e.g. 105° C.). If $T_C$ is lower than $T_{CO}$, program control advances to the step $S_7$ to similarly feedback control the air-to-fuel ratio in response to the detected oxygen sensor signal. In step $S_4$, if $T_A$ is higher than $T_{CO}$, program control advances to step $S_5$. In step $S_5$, an appropriate duty factor Do is retrieved from a look-up table under consideration of the read intake air temperature $T_A$ and the read coolant temperature $T_C$. This retrieved duty factor Do is outputted from the control means 103 in step $S_6$. Therefore, a control signal with a fixed duty factor Do (e.g. 10 percent) is applied to the solenoid value 1F to make rich the mixture obtained through the carburetor 1 for prevention of engine overheat.

Figure 5:
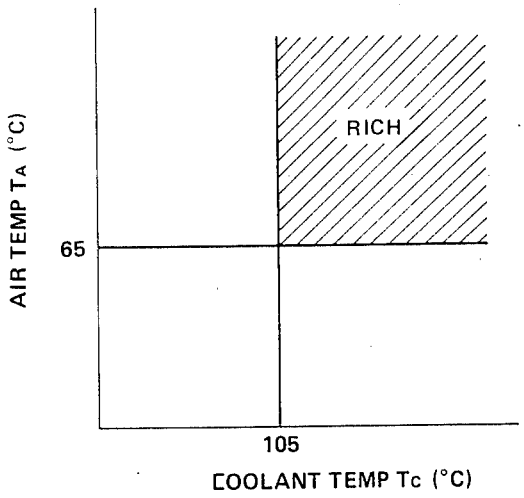
FIG. 5 is a graphical representation showing a range, within which air-to-fuel ratio is controlled so as to obtain rich mixture, under consideration of intake air temperature and engine coolant temperature.

FIG. 5 shows a range by a shaded portion within which a rich mixture having an air-to-fuel ratio lower than a theoretical ratio is obtained. In this drawing, a rich mixture is supplied to prevent engine overheat when intake air temperature exceeds 65° C. and when engine coolant temperature exceeds 105° C. simultaneously.

In the above description, although a rich mixture is supplied under consideration of intake air and coolant temperatures, it is also preferable to supply a rich mixture for prevention of engine overheat when the transmission gear shift lever is set to a position other than Drive positions or when the vehicle speed is zero, because the engine may be overheated when the vehicle is at rest. Further, it is also possible to control ignition timing in the direction that combustion temperature is reduced in addition to the above-mentioned air-to-fuel ratio control. Furthermore, it is also preferable to inhibit the above-mentioned control for supplying a rich mixture when the engine is being started or being idled.

As described above, in the air-to-fuel ratio control system for an engine according to the present invention, since air-to-fuel ratio is controlled so as to obtain a rich mixture when intake air temperature $T_A$ and engine coolant temperature $T_C$ both exceed respective reference values, it is possible to prevent engine overheat at high temperatures.

It will be understood by those skilled in the art that the foregoing description is in terms of a preferred embodiment of the present invention wherein various changes and modifications may be made without departing from the spirit and scope of the invention, as set forth in the appended claims.

What is claimed is:

1. An air-to-fuel ratio control system incorporated with a carburetor for supplying fuel into an engine according to the amount of intake air, which comprises:

(a) an oxygen sensor for detecting oxygen concentration in engine exhaust gas and for outputting an oxygen sensor signal;

(b) an engine coolant temperature sensor for outputting an engine coolant temperature signal;

(c) an intake air temperature sensor for outputting an intake air temperature signal;

(d) air-to-fuel ratio control means for correcting the amount of fuel to be supplied to the engine so as to obtain mixture with a stoichiometric mixture ratio in response to the detected oxygen sensor signal in accordance with feedback method when the detected engine coolant temperature or the detected intake air temperature is below each reference value, for increasing the amount of fuel to be supplied to the engine so as to obtain rich mixture irrespective of the oxygen sensor signal for prevention of engine overheat when the detected engine coolant temperature and the detected intake air temperature exceed each reference value, and for outputting a control signal representative of the amount of fuel; and (e) an actuator associated with the carburetor and activated in response to the control signal outputted from said control means.

2. The air-to-fuel ratio control system as set forth in claim 1, wherein said control means is a microcomputer for outputting a control pulse signal to said actuator, the duty factor thereof being adjusted to correct or increase the amount of fuel to be supplied to the engine through the carburetor.

3. The air-to-fuel ratio control system as set forth in claim 2, wherein said actuator is a solenoid valve disposed in a passage communicating between venturi portion and a float chamber of the carburetor, said solenoid valve being energized in response to the control pulse signal of variable duty factor outputted from said microcomputer in order to increase or decrease an crosssectional area of the passage for correction or increase of the amount of fuel to be supplied to the engine through the carburetor.

4. The air-to-fuel ratio control system as set forth in claim 2, wherein the duty factor of the control pulse signal to increase the amount of fuel for prevention of engine overheat is retrieved from a look-up table stored in said microcomputer under consideration of detected intake air temperature $T_A$ and detected engine coolant temperature $T_C$, when the temperatures $T_A$ and $T_C$ exceed each reference value.

5. The air-to-fuel ratio control system as set forth in claim 4, wherein the duty factor of the control pulse signal to increase fuel for prevention of engine overheat is retrieved from a look-up table stored in said microcomputer under consideration of transmission gear shift lever position in addition to the detected intake air temperature $T_A$ and engine coolant temperature $T_C$, when the temperatures $T_A$ and $T_C$ exceed each reference value.

6. The air-to-fuel ratio control system as set forth in claim 4, wherein the duty factor of the control pulse signal to increase fuel for prevention of engine overheat is retrieved from a look-up table stored in said microcomputer under consideration of vehicle speed in addition to the detected intake air temperature $T_A$ and engine coolant temperature $T_C$, when the temperatures $T_A$ and $T_C$ exceed each reference value.

7. The air-to-fuel ratio control system as set forth in claim 2, wherein the duty factor of the control signal to increase fuel for prevention of engine overheat is simply determined to a fixed value, irrespective of the detected intake air temperature $T_A$ and the detected engine coolant temperature $T_C$, when the temperatures $T_A$ and $T_C$ exceed each reference value.

8. The air-to-fuel ratio control system as set forth in claim 1, wherein the reference intake air temperature is 65° C.

9. The air-to-fuel ratio control system as set forth in claim 1, wherein the reference engine coolant temperature is 105° C.

10. A method of increasing fuel supplied to an engine for prevention of engine overheat in cooperation with a carburetor for adjustably supplying fuel into the engine so that air-to-fuel ratio can be controlled to a stoichiometric mixture ratio in response to oxygen sensor signals in accordance with feedback control method, which comprises the following steps of:

(a) detecting intake air temperature $T_A$;

(b) comparing the detected intake air temperature $T_A$ with a reference value $T_{AO}$;

(c) if the detected intake air temperature $T_A$ is lower than the reference value $T_{AO}$, supplying fuel into the engine in response to the oxygen sensor signals and in accordance with feedback control method;

(d) if the detected intake air temperature $T_A$ is higher than the reference value $T_{AO}$, detecting engine coolant temperature $T_C$;

(e) comparing the detected engine coolant temperature $T_C$ with a reference value $T_{CO}$;

(f) if the detected engine coolant temperature $T_C$ is lower than the reference value $T_{CO}$, supplying fuel into the engine in response to the oxygen sensor signals and in accordance with feedback control method;

(g) if the detected engine coolant temperature $T_C$ is higher than the reference value $T_{CO}$, selecting a duty factor from a look-up table under consideration of the detected intake air temperature $T_A$ and the detected engine coolant temperature $T_C$;

(h) generating a control pulse signal having the selected duty factor; and (i) activating an actuator associated with the carburetor in response to the control pulse signal to increase the amount of fuel to be supplied to the engine through the carburetor.

11. A method of increasing fuel supplied to an engine as set forth in claim 10, which further comprises the step of detecting vehicle speed for selecting a duty factor from a look-up table under consideration of the detected vehicle speed in addition to the detected intake air temperature $T_A$ and the detected engine coolant temperature $T_C$.

12. A method of increasing fuel supplied to an engine for prevention of engine overheat in cooperation with a carburetor for adjustably supplying fuel into the engine so that air-to-fuel ratio can be controlled to a stoichiometric mixture ratio in response to oxygen sensor signals in accordance with feedback control method, which comprises the following steps of:

(a) detecting intake air temperature $T_A$;

(b) comparing the detected intake air temperature $T_A$ with a reference value $T_{AO}$;

(c) if the detected intake air temperature $T_A$ is lower than the reference value $T_{AO}$, supplying fuel into the engine in response to the oxygen sensor signals and in accordance with feedback control method;

(d) if the detected intake air temperature $T_A$ is higher than the reference value $T_{AO}$, detecting engine coolant temperature $T_C$;

(e) comparing the detected engine coolant temperature $T_C$ with a reference value $T_{CO}$;

(f) if the detected engine coolant temperature $T_C$ is lower than the reference value $T_{CO}$, supplying fuel into the engine in response to the oxygen sensor signals and in accordance with feedback control method;

(g) if the detected engine coolant temperature $T_C$ is higher than the reference value $T_{CO}$, determining a predetermined duty factor without consideration of the detected intake air temperature $T_A$ and the detected engine coolant temperature $T_C$;

(h) generating a control pulse signal having the predetermined duty factor; and (i) activating an actuator associated with the carburetor in response to the control pulse signal to increase the amount of fuel to be supplied to the engine through the carburetor.

* * * * *